US009840944B2

(12) United States Patent
Hopkins

(10) Patent No.: US 9,840,944 B2
(45) Date of Patent: Dec. 12, 2017

(54) SPRING SUPPORT AND RETENTION MEMBER FOR A CAMSHAFT PHASER

(71) Applicant: Schaeffler Technologies AG & Co. KG, Herzogenaurach (DE)

(72) Inventor: Sarah Hopkins, Royal Oak, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 107 days.

(21) Appl. No.: 15/054,666

(22) Filed: Feb. 26, 2016

(65) Prior Publication Data

US 2017/0248046 A1 Aug. 31, 2017

(51) Int. Cl.

| | |
|---|---|
| ***F01L 1/34*** | (2006.01) |
| ***F01L 1/344*** | (2006.01) |
| ***F01L 1/46*** | (2006.01) |

(52) U.S. Cl.

CPC ..... *F01L 1/3442* (2013.01); *F01L 1/46* (2013.01); *F01L 2001/34483* (2013.01)

(58) Field of Classification Search

CPC .. F01L 1/3442; F01L 1/46; F01L 2001/34483
USPC ..... 123/90.15, 90.17
See application file for complete search history.

(56) References Cited

U.S. PATENT DOCUMENTS

| | | | | |
|---|---|---|---|---|
| 4,886,392 | A | 12/1989 | Iio | |
| 9,074,497 | B2 * | 7/2015 | Schulte | F01L 1/344 123/90.17 |
| 2009/0211549 | A1 | 8/2009 | Myers et al. | |
| 2015/0345344 | A1 | 12/2015 | Hopkins | |

FOREIGN PATENT DOCUMENTS

| | | | |
|---|---|---|---|
| CA | 2635263 | A1 | 7/2007 |
| EP | 1486645 | A1 | 12/2004 |

* cited by examiner

*Primary Examiner* — Ching Chang
(74) *Attorney, Agent, or Firm* — Volpe and Koenig, P.C.

(57) ABSTRACT

A camshaft phaser has a stator configured to be non-rotatably connected to a drive sprocket and a rotor at least partially rotatable with respect to the stator and configured to be non-rotatably connected to a camshaft. The rotor has an aperture extending in a direction parallel to an axis of rotation. The camshaft phaser further has a support member including a bushing including an elongated portion, a flange, and a through-bore extending through the elongated portion and the flange, and a cylindrical pin disposed in the through-bore and the aperture. The camshaft phaser also has a positioning spring engaged with the support member and the stator to bias the rotor in a circumferential direction.

14 Claims, 4 Drawing Sheets

SPRING SUPPORT AND RETENTION MEMBER FOR A CAMSHAFT PHASER

FIELD OF INVENTION

The present invention relates to a support member, and, more particularly, to a spring support and retention member for a camshaft phaser.

BACKGROUND

Many camshaft phasers include a positioning spring that biases a rotor in a circumferential direction with respect to a stator by being connected at one end to the stator and at another end to the rotor. The positioning spring must be retained axially and radially during use in order to remain in its proper position within the camshaft phaser.

For example, U.S. Patent Application Publication No. 2009/0211549 discloses stop members for retaining a pair of spiral springs radially and a spring retention plate for retaining the springs axially. While this configuration retains the spiral spring in position, the use of a spring retention plate, separate from radial stop members, increases the number of components of the camshaft phaser, which increases cost. Further, the spring retention plate increases the size of the camshaft phaser. Due to space restrictions within an engine, it would be advantageous to minimize the size of the camshaft phaser.

Current configurations that do not include a spring retention plate, such as those that use press-fit nail-head pins, include other drawbacks. For example, such nail-head pins require an additional grinding operation in order to precisely size the nail-head pins so that they are reliably held in position when pressed in to the corresponding holes in the camshaft phaser housing. This additional grinding operation introduces additional cost and complexity to the assembly of the camshaft phaser. Furthermore, the nail-head pins are required to carry both bending and shear loads as they are positioned in apertures in the rotor and/or stator to retain the spring, and accordingly must be formed of a high strength, preferably steel, material to carry the loads, which makes the forming process more costly in comparison to straight steel pins, such as bearing needles, which have also been used for radial retention of such springs.

The present disclosure is directed to overcoming one or more problems of the prior art.

SUMMARY

In one aspect, the present disclosure is directed to a camshaft phaser. The camshaft phaser is positioned with respect to an axis of rotation. The camshaft phaser includes a stator configured to be non-rotatably connected to a drive wheel and a rotor at least partially rotatable with respect to the stator and configured to be non-rotatably connected to a camshaft. The rotor includes an aperture extending in a direction parallel to the axis of rotation. The camshaft phaser further includes a support member including a bushing including an elongated portion, a flange, and a through-bore extending through the elongated portion and the flange, and a cylindrical pin disposed in the through-bore and the aperture. The camshaft phaser also includes a positioning spring engaged with the support member and the stator to bias the rotor in a circumferential direction.

In another aspect, the present disclosure is directed to a method of assembling a camshaft phaser. The method includes inserting a cylindrical pin into a through-bore of a bushing and an aperture formed in a rotor such that the bushing is secured to the rotor. The method also includes engaging a positioning spring with the bushing and a stator of the camshaft phaser, thereby biasing the rotor in a circumferential direction with respect to the stator. The positioning spring is engaged with the bushing such that the positioning spring is retained radially and axially.

BRIEF DESCRIPTION OF THE DRAWING(S)

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENT(S)

Figure 1:
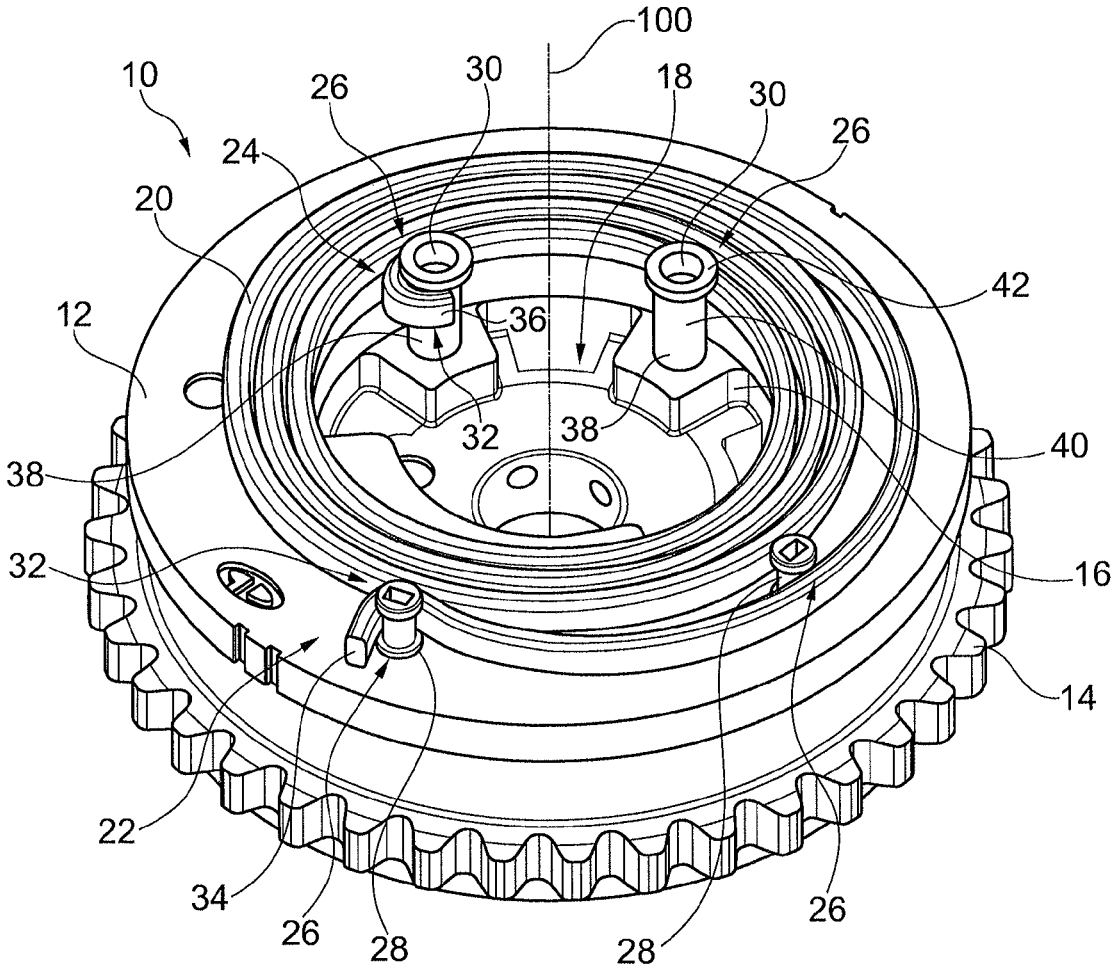
FIG. 1 is a perspective view of a camshaft phaser including a support member.

FIG. 1 shows an exemplary camshaft phaser 10 positioned with respect to an axis of rotation 100. The camshaft phaser 10 includes a stator 12 configured to be non-rotatably connected to a drive wheel, such as a sprocket 14 or toothed pulley. The camshaft phaser 10 further includes a rotor 16 configured to be non-rotatably connected to a camshaft (not shown). The rotor 16 is at least partially rotatable with respect to the stator 12. In this way, a camshaft may be selectively phased in order to alter a valve timing of an associated engine (e.g., in a manner known in the art).

The stator 12 includes a stator body and may further include one or more additional components. For example, the stator 12 may include one or more circumferentially extending hydraulic chambers, pressure plates and/or sealing plates non-rotatably connected to the stator body. The stator 12 further includes an opening 18 for receiving at least a portion of the rotor 16 therein.

The rotor 16 includes a rotor body and may further include one or more additional components. In one embodiment, the rotor 16 may include one or more components configured to cause the rotor 16 to rotate with respect to the stator 12. For example, the rotor 16 may include vanes that extend into and divide the chambers in the stator as well as hydraulic components known in the art (e.g., solenoid valve, pin, spring, etc.) for causing the rotor 16 to rotate with respect to the stator 12, for example by pressurizing one or both sides of the divided hydraulic chambers to cause the vane to move in one or the other circumferential directions or to be fixed in position.

The camshaft phaser 10 further includes a positioning spring 20. The positioning spring 20 biases the rotor 16 in a circumferential direction toward an angular position with respect to the stator 12. The rotor 16 is rotatable (e.g., via the hydraulic components described above) against the force of the positioning spring 20. The positioning spring 20 includes a stator end 22 and a rotor end 24. The stator end 22 is connected to the stator 12 and the rotor end 24 is connected to the rotor 16.

The camshaft phaser 10 further includes a plurality of support members 26 configured to secure the positioning spring 20 to the stator 12 and/or the rotor 16. The positioning spring 20 engages the support members 26 to bias the rotor 16 in the circumferential direction. For example, the support members 26 include one or more stator support members 28 configured to guide the spring and/or secure the stator end 22 to the stator 12 and one or more rotor support members 30 configured to guide the spring and/or secure the rotor end 24 to the rotor 16.

In an exemplary embodiment, the positioning spring 20 includes a connection feature 32 at one or both of the stator end 22 or the rotor end 24 for securing the positioning spring 20 to a support member 26. For example, the stator end 22 may include a first hook 34 configured to be placed around a selected stator support member 28 and the rotor end 24 may include a second hook 36 configured to be placed around a selected rotor support member 30.

In an exemplary embodiment, at least one of the support members 26 is configured to radially and axially retain the positioning spring 20 on the stator 12 and/or rotor 16. For example, at least the rotor support members 30 may include a bushing 38 configured to radially and axially retain the positioning spring 20 on the rotor 16.

The bushing 38 includes an elongated portion 40 and a flange 42. In an exemplary embodiment, the elongated portion 40 retains the positioning spring 20 radially. For example, the second hook 36 is placed around an exterior of the elongated portion 40 such that the positioning spring 20 is prevented from shifting in at least one radial direction. The flange 42 retains the positioning spring 20 axially. For example, the flange 42 extends over at least a portion of the positioning spring 20 such that at least a portion of the positioning spring 20 is prevented from shifting axially away from the rotor 16.

Figure 2:
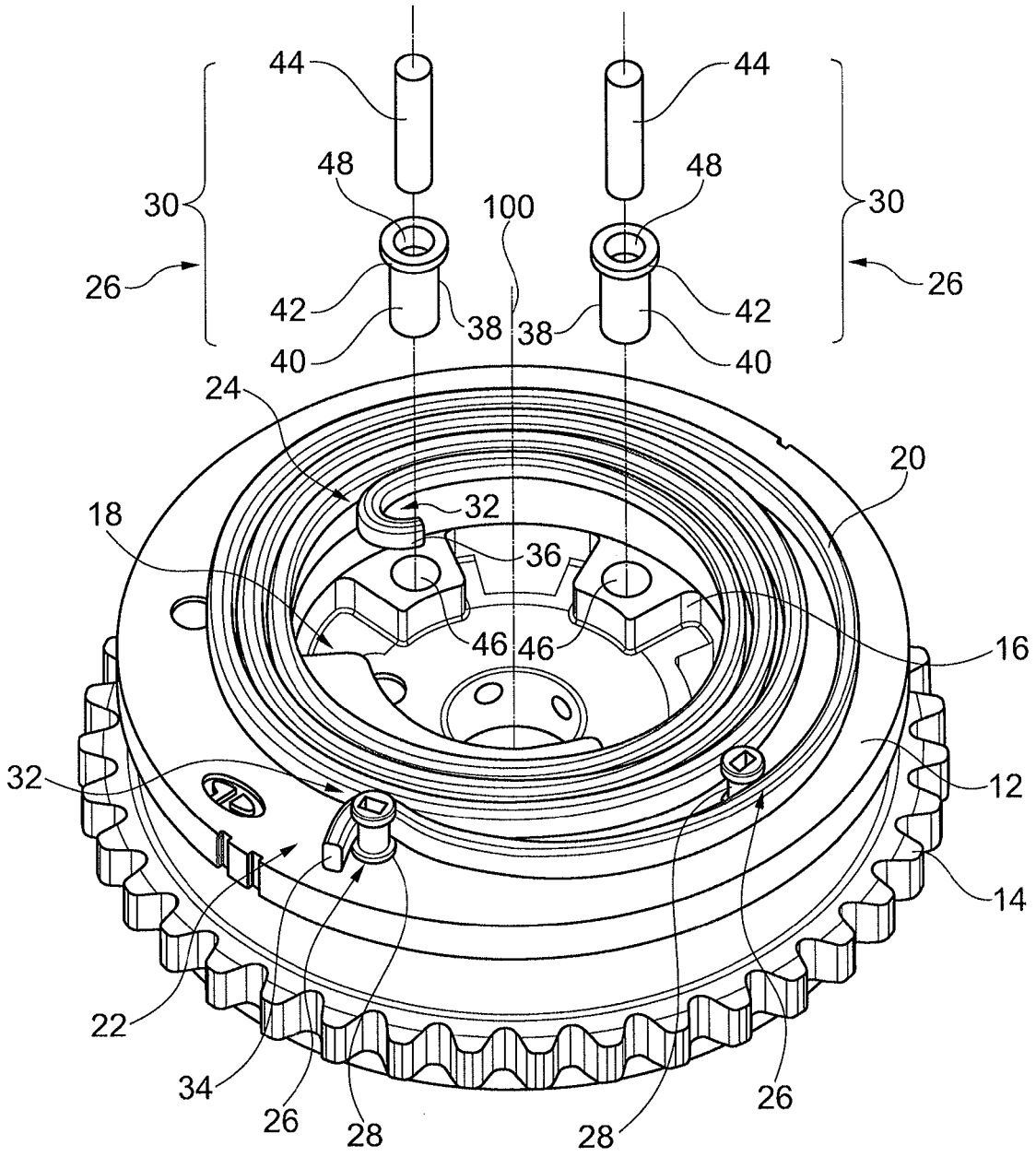
FIG. 2 is a perspective view of the camshaft phaser of FIG. 1, including an exploded view of the support member.

FIG. 2 further illustrates the components of rotor support members 30, which each include the bushing 38 and a cylindrical pin 44. As shown in FIG. 2, the rotor 16 further includes an aperture 46 corresponding to the location of each of the rotor support members 30. The aperture 46 extends in a direction parallel to the axis of rotation 100.

The bushing 38 further includes a through-bore 48 extending through the elongated portion 40 and the flange 42. Further, the elongated portion 40 and the flange 42 of the bushing 38 may be integrally formed as one piece. In an exemplary embodiment, the cylindrical pin 44 consists only of a solid cylinder (i.e., the cylindrical pin 44 does not include additional shapes and/or features). Preferably, this is made of steel, and can be, for example, a bearing needle that is precision ground to a precise size that allows for uniform assembly with an interference fit and sufficient strength to carry both shear and bending loads from the spring.

Figure 3:
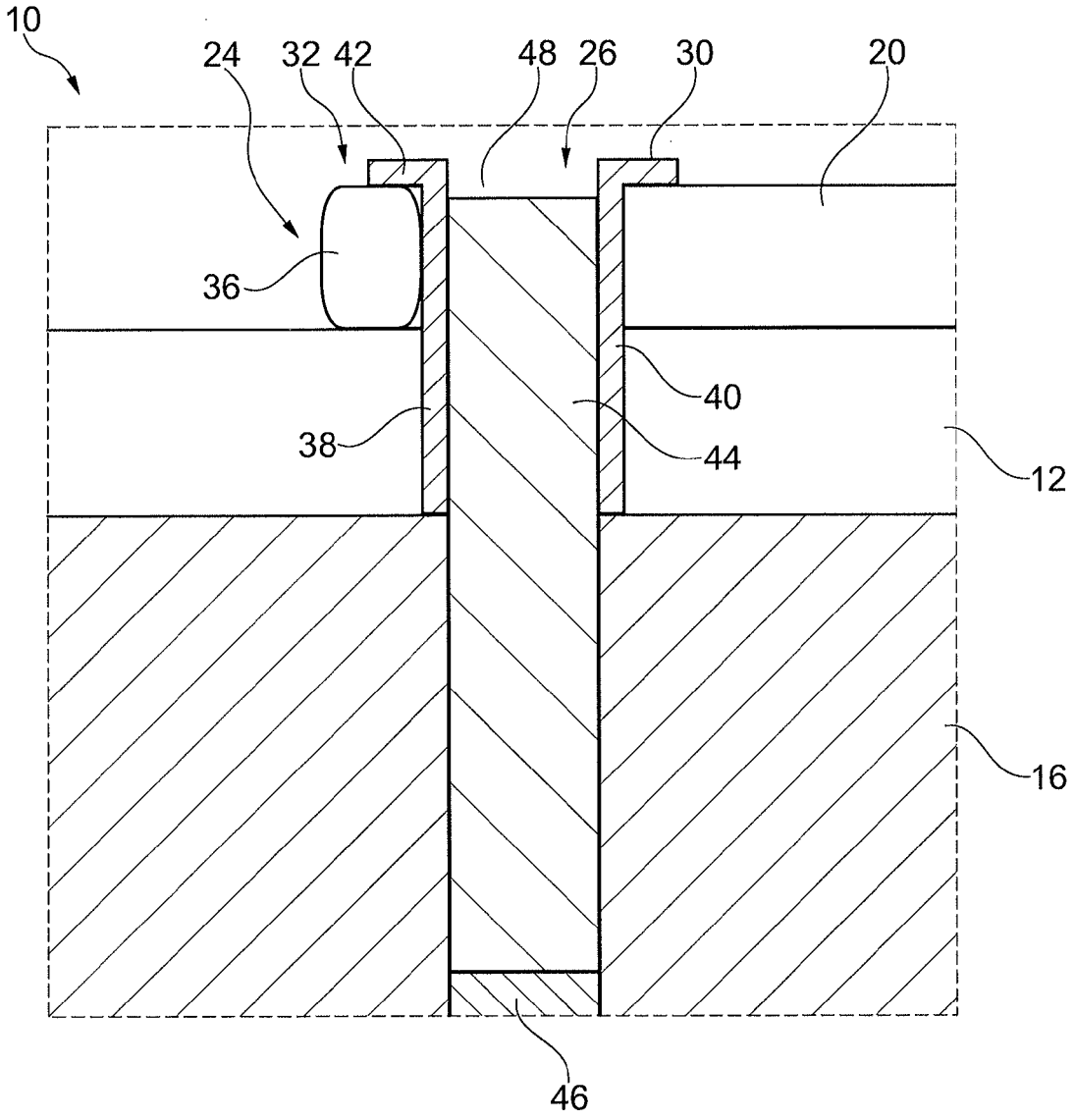
FIG. 3 is a cross-sectional view of a portion of the camshaft phaser of FIGS. 1-2, including the support member.

FIG. 3 illustrates a cross-sectional view of a portion of the camshaft phaser 10 that includes a rotor support member 30. As shown, the bushing 38 is connected to the rotor 16 via the cylindrical pin 44 being positioned in the aperture 46, preferably with an interference fit, and the through-bore 48, preferably also with an interference fit. The bushing 38 is positioned entirely outside of the aperture 46 in the rotor 16.

In an exemplary embodiment, the cylindrical pin 44 is formed with a diameter that is slightly larger than the diameters of the aperture 46 and the through-bore 48 such that the cylindrical pin 44 may be press-fit into the aperture 46 and through-bore 48 to connect the bushing 38 to the rotor 16. It should be understood, however, that other configurations of the cylindrical pin 44 are possible. For example, adhesive, welding, threading, etc., may be used.

In order to secure the bushing 38 to the rotor 16, the cylindrical pin 44 is inserted (e.g., press-fit) in the through-bore 48 and the aperture 46 such that the bushing 38 is secured to the rotor 16. It should be understood that different sequences of steps for attaching the bushing 38 to the rotor 16 are possible. In one exemplary embodiment, the through-bore 48 is first aligned with the aperture 46 and the cylindrical pin 44 is inserted into the aligned aperture 46 and through-bore 48.

In other embodiments, the cylindrical pin 44 may be preassembled with the bushing 38 or the rotor 16. For example, in one embodiment, a first end of the cylindrical pin 44 is inserted into the through-bore 48 to form a bushing assembly. The bushing assembly is thereafter secured to the rotor 16 by inserting a second end of the cylindrical pin 44 that projects from the bushing 38 into the aperture 46. In another exemplary embodiment, a first end of the cylindrical pin 44 is first inserted into the aperture 46 such that a second end of the cylindrical pin 44 projects from the rotor 16. The bushing 38 is thereafter secured to the cylindrical pin 44 such that the second end of the cylindrical pin 44 is disposed in the through-bore 48.

It should be understood that one or more of these disclosed methods may be used to attach the bushing 38 to an aperture 46 in the rotor 16 to form the rotor support members 30, and/or to attach a bushing 38 to an aperture (not shown) in the stator 12 to form the stator support members 28. After the bushing 38 is secured to the rotor 16 (and/or stator 12), the positioning spring 20 is positioned to engage the stator support members 28 and the rotor support members 30. For example, the positioning spring 20 is positioned such that a first side contacts the elongated portion 40 and a second side contacts the flange 42, thus radially and axially retaining at least a portion of the positioning spring 20 in position on the camshaft phaser 10.

Figure 4:
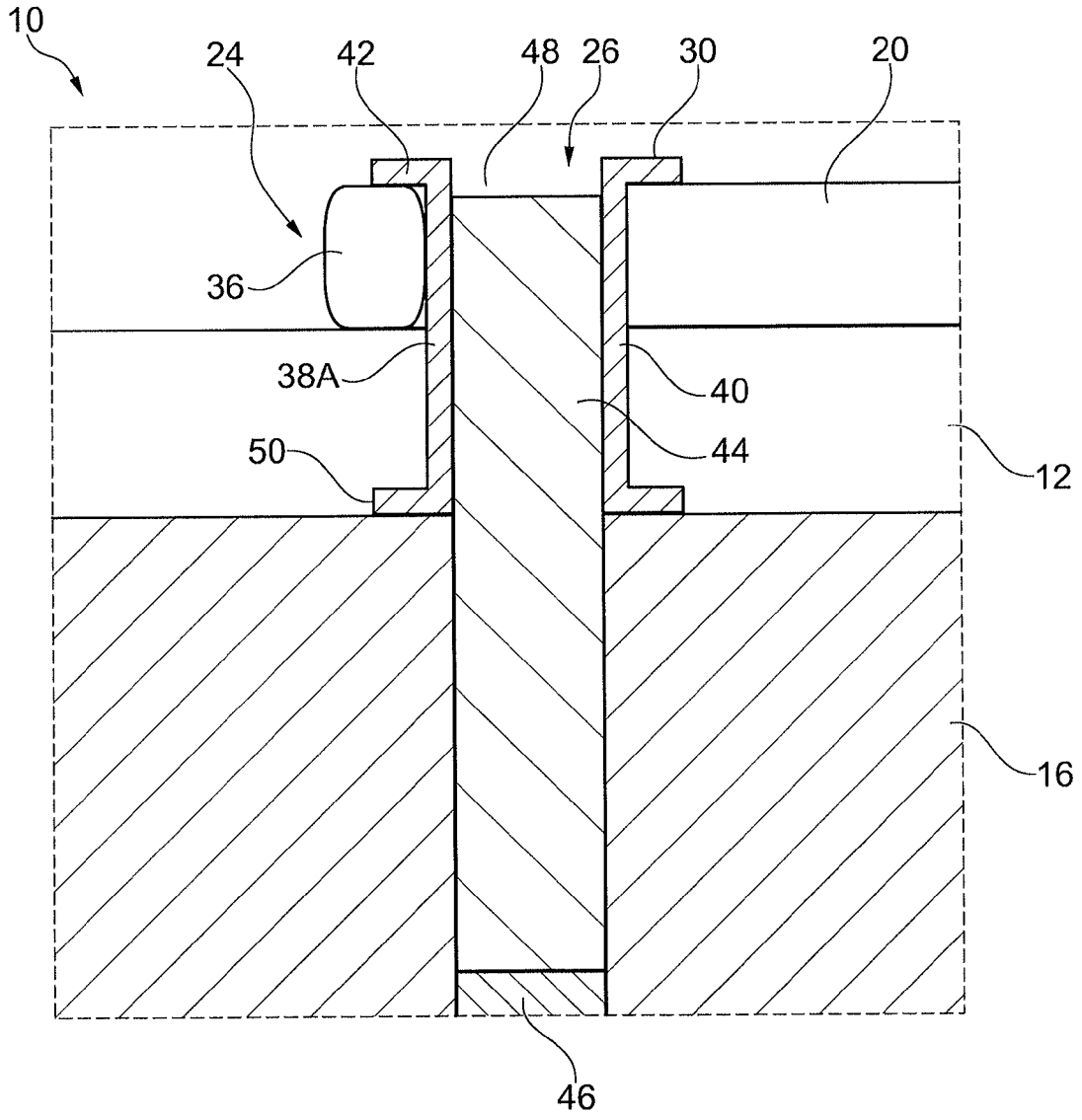
FIG. 4 is another cross-sectional view of a portion of the camshaft phaser of FIGS. 1-2, including an alternative embodiment of the support member.

FIG. 4 illustrates another cross-sectional view of a portion of the camshaft phaser 10, including a support member 26 according to an alternative embodiment. In the embodiment of FIG. 4, the support member 26 includes a bushing 38A. The bushing 38A is the same as the bushing 38, except that the bushing 38A additionally includes a base flange 50 positioned on an opposite end of the elongated portion 40 from the flange 42. As shown in FIG. 4, the base flange 50 abuts a surface of the rotor 16. The base flange 50 provides a supporting base to the bushing 38, acting as a stop and helping to distribute any axial forces placed on the support member 26.

The disclosed support member 26 is particularly applicable to retaining a positioning spring on a camshaft phaser, as described herein. The configuration of the support member 26, including a separate bushing 38 and cylindrical pin 44, provide several advantages. For example, the combination of the elongated portion 40 and flange 42 retains at least a portion of the positioning spring 20 radially and axially, thus removing the need for a separate spring retention plate and helping to minimize a size of the camshaft phaser 10. Moreover, the use of the cylindrical pin 44, which may be made inexpensively, to bear the load, helps to reduce cost as compared to headed pins that require an additional grinding operation. Further, because the bushing 38 is positioned entirely outside of the aperture 46, it is not exposed to a shear force that may cause failure and allows the bushing 38 to be fabricated from a relatively inexpensive material, such as a lower grade steel, and with larger tolerances.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A camshaft phaser positioned with respect to an axis of rotation, the camshaft phaser comprising:

a stator configured to be non-rotatably connected to a drive wheel;

a rotor at least partially rotatable with respect to the stator and configured to be non-rotatably connected to a camshaft, the rotor including an aperture extending in a direction parallel to the axis of rotation;

a support member including:

a bushing including an elongated portion, a flange, and a through-bore extending through the elongated portion and the flange; and a cylindrical pin disposed in the through-bore and the aperture; and a positioning spring engaged with the support member and the stator to bias the rotor in a circumferential direction.

2. The camshaft phaser of claim 1, wherein the elongated portion retains the positioning spring radially and the flange retains the positioning spring axially.

3. The camshaft phaser of claim 1, wherein the cylindrical pin is press-fit into the through-bore and the aperture.

4. The camshaft phaser of claim 1, wherein the bushing is positioned entirely outside of the aperture.

5. The camshaft phaser of claim 4, wherein the elongated portion and the flange are integrally formed as one piece.

6. The camshaft phaser of claim 1, wherein the cylindrical pin consists of a solid cylinder.

7. The camshaft phaser of claim 1, wherein the bushing further includes a base flange abutting a surface of the rotor.

8. A method of assembling a camshaft phaser, comprising:

inserting a cylindrical pin into a through-bore of a bushing and an aperture formed in a rotor such that the bushing is secured to the rotor; and engaging a positioning spring with the bushing and a stator of the camshaft phaser, thereby biasing the rotor in a circumferential direction with respect to the stator, wherein the positioning spring is engaged with the bushing such that the positioning spring is retained radially and axially.

9. The method of claim 8, wherein engaging the positioning spring with the bushing includes contacting a first side of the positioning spring with an elongated portion of the bushing and contacting a second side of the positioning spring with a flange of the bushing.

10. The method of claim 9, wherein the elongated portion retains the positioning spring radially and the flange retains the positioning spring axially.

11. The method of claim 8, wherein inserting the cylindrical pin includes:

aligning the through-bore of the bushing with the aperture prior to inserting the cylindrical pin, and inserting the cylindrical pin into the aligned through-bore and aperture.

12. The method of claim 8, wherein inserting the cylindrical pin includes:

inserting a first end of the cylindrical pin into the through-bore to form a bushing assembly, and securing the bushing assembly to the rotor by inserting a second end of the cylindrical pin that projects from the bushing into the aperture.

13. The method of claim 8, wherein inserting the cylindrical pin includes:

inserting a first end of the cylindrical pin into the aperture such that a second end of the cylindrical pin projects from the rotor, and securing the bushing on the second end of the cylindrical pin that projects from the rotor such that the second end of the cylindrical pin is disposed in the through-bore.

14. The method of claim 8, wherein inserting the cylindrical pin includes press-fitting the cylindrical pin in the aperture and the through-bore.

* * * * *